US006544348B1

(12) United States Patent
Stöckigt et al.

(10) Patent No.: US 6,544,348 B1
(45) Date of Patent: Apr. 8, 2003

(54) METHOD FOR CLEANING PRINTING MACHINES AND PRINTING MOULDS

(75) Inventors: Dieter Stöckigt, Ludwigshafen (DE); Günter Oetter, Frankenthal (DE); Erwin Wolff, Frankenthal (DE); Erich Frank, Göppingen (DE); Petra Schneider, Korntal-Münchingen (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/701,370

(22) PCT Filed: May 20, 1999

(86) PCT No.: PCT/EP99/03479

§ 371 (c)(1),
(2), (4) Date: Nov. 29, 2000

(87) PCT Pub. No.: WO99/62723

PCT Pub. Date: Dec. 9, 1999

(30) Foreign Application Priority Data

May 29, 1998 (DE) ..... 198 24 236

(51) Int. Cl.[7] ..... B08B 3/04; B08B 3/08

(52) U.S. Cl. ..... 134/40; 510/170; 510/174; 510/238; 510/365; 510/417; 510/424; 510/505; 510/506

(58) Field of Search ..... 510/417, 424, 510/505, 506, 365, 238, 170, 174; 134/40

(56) References Cited

U.S. PATENT DOCUMENTS

| | | | | |
|---|---|---|---|---|
| 4,100,096 | A | | 7/1978 | Rubin |
| 5,194,173 | A | * | 3/1993 | Folkard et al. |
| 5,213,624 | A | | 5/1993 | Williams |
| 5,380,453 | A | * | 1/1995 | Krawack |

FOREIGN PATENT DOCUMENTS

| | | |
|---|---|---|
| DE | 27 24 557 | 12/1977 |
| EP | 0 498 545 | 8/1992 |
| EP | 0 527 315 | 2/1993 |
| EP | 0 637 629 | 2/1995 |
| GB | 2 089 289 | 6/1982 |
| WO | 90/03419 | 4/1990 |

* cited by examiner

*Primary Examiner*—Gregory E. Webb
(74) *Attorney, Agent, or Firm*—Oblon, Spivak, McClelland, Maier & Neustadt, P.C.

(57) ABSTRACT

A process is proposed for cleaning printing machines or printing plates by removing the contaminants from the surfaces to be cleaned by washing them with a microemulsion comprising water, a surfactant, and a water-immiscible organic solvent.

7 Claims, No Drawings

METHOD FOR CLEANING PRINTING MACHINES AND PRINTING MOULDS

The invention relates to a process for cleaning printing machines and printing plates to remove, in particular, printing inks—for example, oil-based or radiation-curable printing inks—from the cylinders and rollers of printing machines, especially planographic or offset printing machines, and from printing plates, during, for example, an interruption in the printing process.

For said purposes it is common to employ cleaners based on organic solvents and/or aqueous solutions. When machines are at a prolonged standstill in printing plants, or when there is a change of ink, the parts of the printing machine that have come into contact with the printing ink are freed from ink residues. Similarly, when there is an interruption in the printing process, it is necessary to clean printing plates, especially planographic printing plates, carefully in order to remove ink residues and to coat them with preserving solutions based on hydrophilic polymers in order to maintain the hydrophilicity of the nonimage areas. Cleaners containing organic solvents usually have volatile organic components (VOCs) which pollute the atmosphere and are unacceptable from an environmental and workplace health and safety standpoint. Cleaners consisting exclusively or predominantly of apolar organic solvents, furthermore, have the disadvantage that solvent residues which adhere to the parts to be cleaned, such as printing rollers, cannot be washed off with water after cleaning. A clean printing roller, however, is vital for good wetting with printing ink and for effective ink transfer. In the case of some printing plates it is also possible for the ink-carrying print stencil to undergo incipient dissolution by the cleaner and, as a result, to become damaged or even unusable.

DE-B 27 24 557 describes a cleaner for lithographic printing plates which comprises water and water-miscible organic solvents. Its cleaning action with respect to viscous oil-based printing inks is naturally limited.

GB-A 2 089 289 describes oil-in-water and water-in-oil emulsions as cleaners. A disadvantage in this case is the relatively high interfacial tension between the water phase and the oil phase, so that, for example, lipophilic, strongly hydrophobic offset printing inks, owing to their high surface energy, are taken up only slowly and minimally by the continuous water phase cleaner solution.

Similar comments apply to emulsions as described, for example, in WO-A 90/03419 or EP-A 0 498 545.

Furthermore, emulsions of this kind are stable only kinetically but not thermodynamically, so that, especially in the case of temperature fluctuations, they have a tendency to separate [creaming (settling), thickening, flocculation] and so are impaired in their usefulness.

A particularly difficult task is the removal of UV-curable offset or relief inks based on polymerizable monomeric or oligomeric acrylates. They are generally removed using esters or mixtures of esters and mineral oil.

It is an object of the present invention to provide a cleaning process and a liquid cleaner (cleaning composition) which permit the rapid and effective detachment of printing inks without polluting the local environment by vapors from volatile organic components or attacking the print stencil of printing plates.

We have found that this object is achieved by a process for cleaning printing machines or printing plates by removing the contaminants from the surface by washing with a liquid, wherein said liquid is a preferably bicontinuous microemulsion comprising water, a surfactant and, as the oil phase, a water-immiscible organic solvent.

For the purposes of the present specification a microemulsion is a liquid mixture, preferably a bicontinuous mixture, of water phase and oil phase with an extremely low interfacial tension between water phase and oil phase, i.e., an interfacial tension up to three powers of ten lower than that of a conventional water-in-oil or oil-in-water emulsion. In the case of microemulsions this interfacial tension is in the range from $10^{-3}$ to $10^{-7}$ N/m, preferably from $10^{-4}$ to $10^{-6}$ N/m, and in the case of emulsions customarily in the range from $10^{-3}$ to $10^{-2}$ N/m. A microemulsion in the present specification is thermodynamically stable, visually transparent and preferably of low viscosity.

Customary, conventional emulsions may comprise oil phase and water phase in very different proportions by volume. They have a continuous phase and a disperse phase which is present as very small spherules, stabilized by coating with surfactants, in the continuous phase. Depending on the nature of the continuous phase the emulsions are referred to as oil-in-water or water-in-oil emulsions. Ideally these emulsions are kinetically stable, i.e., they persist for prolonged periods although not ad infinitum. In the case of fluctuating temperatures in particular, they may tend toward phase separation by settling, creaming, thickening or flocculating.

Bicontinuous microemulsions comprise two phases, a water phase and an oil phase, in the form of extended, adjacent and interpenetrating domains at the interface between which there is an accumulation of stabilizing surfactants in a monomolecular layer. Bicontinuous microemulsions form very easily, usually spontaneously on account of the very low interfacial tension, when the individual components—water, oil and a suitable surfactant system—are mixed. Since the domains have only very small extents in at least one dimension, in the order of magnitude of nanometers, the microemulsions appear visually transparent and are stable thermodynamically, i.e., for an unlimited time, within a certain temperature range depending on the surfactant system employed.

Bicontinuous microemulsions are described, for example, in the article "Mikroemulsionen—eine wissenschaftliche und anwendungstechnische Fundgrube?" [Microemulsions—a scientific and technological treasure chest?] by H.-F. Eicke in SÖFW-Journal 118 (1992), pages 311 to 314.

In order to achieve the required low interfacial tension at the phase boundaries the microemulsions comprise certain amphiphiles, i.e., surfactants, and also often comprise, in their aqueous phase, dissolved electrolytes and, if desired, further auxiliaries. Electrolytes are added in particular when the amphiphiles are partly or exclusively ionic surfactants.

The use of microemulsions to extract organic pollutants from contaminated soils is described in WO 94/04289. The tertiary extraction of petroleum is another known field of application for microemulsions.

In addition, EP-A-0 498 545 discloses the use of microemulsions as cleaners for surfaces such as those of coated or untreated metal panels, plastics and other surfaces, in particular for the purpose of pretreatment for subsequent coatings.

The invention additionally provides a cleaning composition for conducting the process of the invention, said composition consisting of a microemulsion comprising water, a surfactant and a water-immiscible organic solvent.

The constituents of the microemulsions should be selected such that they do not alter the mechanical properties of components of equipment or sealing materials made of rubber or similar materials, such as their elasticity, flexibility, dimensional stability, etc., as a result of swelling or shrinkage (deswelling).

Water-immiscible organic solvents used are with advantage those having a boiling range above 100° C., preferably above 150° C. and, in particular, from 200 to 400° C. In general, organic solvents having flash points above 100° C. are employed. By organic solvents are meant, inter alia, fats and oils, such as colza oil, fatty acid esters, ethers, ketones, aldehydes, and hydrocarbons.

Generally suitable are esters, especially alkyl esters, of relatively long-chain fatty acids. The alkyl group of the alcohol component generally has 1 to 20, preferably 1 to 16 carbon atoms. The fatty acid component normally has 6 to 25, preferably 8 to 18 carbon atoms and can be linear or branched, saturated or unsaturated and contain up to three double bonds in the molecule. The esters generally have an iodine number of from 0 to about 150, preferably from 0 to 40. Compounds with a higher double bond content frequently show a tendency toward resinification and hence toward the deposition of unwanted substances. Such compounds are therefore added only in small amounts if at all. Examples of suitable esters are methyl, ethyl, isopropyl, n-butyl, n-hexyl, 2-ethylhexyl esters and/or isooctyl esters of fatty acids or fatty acid mixtures, examples being those of octanoic, 2-ethylhexanoic, capric, lauric, myristic, palmitic, oleic, linoleic or behenic acids or of soya oil, coconut oil, palm kernel oil, palm oil, sunflower oil, sperm oil, tall oil, rapeseed oil, castor oil or tallow fatty acids. Examples of specific typical esters are coconut fatty acid 2-ethylhexyl ester, tall oil fatty acid n-hexyl ester, rapeseed oil methyl ester, methyl oleate, methyl stearate, isopropyl palmitate, ethyl laurate, 2-ethylhexyl 2-ethylhexanoate, and n-octyl octanoate. In addition to these esters, ethers with a high boiling range, such as dioctyl ethers, and also triglycerides, such as rapeseed oil, coconut oil or soya oil, are also suitable.

A feature of the esters is their very low vapor pressure, so that no atmospheric pollution is caused when they are used. As is generally the case with bicontinuous microemulsions, the proportions of aqueous and organic phase by volume are approximately within the same order of magnitude; i.e., the volume ratio of water to organic phase is generally from 10:90 to 90:10, preferably from 25:75 to 75:25 and, in particular, from 40:60 to 60:40.

As surfactants it is possible in principle to employ those which differ in their amphiphilic nature, viz. anionic, cationic, amphoteric and nonionic surfactants or mixtures thereof.

Suitable anionic surfactants are $C_{10}$ to $C_{20}$, preferably $C_{12}$ to $C_{16}$ alkyl sulfates, for example, sodium dodecyl sulfate; $C_{10}$ to $C_{20}$, preferably $C_{12}$ to $C_{16}$ alkyl polyether sulfates, for example, sodium dodecyloxypolyethoxysulfate; alkali metal salts of diisooctylsulfosuccinic acid; alkali metal salts of alkylbenzenesulfonic acids, for example, sodium dodecylbenzenesulfonate, of dialkyl phosphates, and of carboxylates, for example, of fatty alkyl ether carboxylates. Some anionic surfactants, an example being sodium dodecyl sulfate, are often used together with alkanols such as butanol, pentanol or hexanol as cosurfactants and/or with alkali metal salts or alkaline earth metal salts, for example, sodium chloride or sodium sulfate or calcium chloride, or with other electrolytes, for example NaOH, KOH, phosphates or silicates. In addition, the microemulsions employed in accordance with the invention may also include complexing agents such as ethylenediaminetetraacetic acid, nitrilotriacetic acid or methylglycinediacetic acid, corrosion inhibitors and/or preservatives.

The alkanols can be added in amounts of up to 20% by weight, preferably up to 10% by weight, and the electrolytes in amounts up to 10% by weight, preferably up to 5% by weight. Cationic surfactants which can be used to prepare microemulsions are, for example, alkyltrimethylammonium halides having alkyl chain lengths of about 8 to 18 carbon atoms and/or quaternized imidazolinium salts or pyridinium salts.

Suitable nonionic or nonionogenic surfactants are polyglycol monoalkyl ethers with alkyl chain lengths from $C_8$ to $C_{18}$, preferably $C_{10}$ to $C_{16}$, and from 2 to 20, preferably from 3 to 15 oxyalkylene, especially oxyethylene, oxypropylene and/or oxybutylene, units, or block copolymers comprising these units. It is common to use $C_{10}$ to $C_{15}$ alkyl ethers of polyglycols having 3 to 10 oxyalkylene units. In the majority of cases these are technical-grade products having a more or less broad molecular weight distribution. Surfactants having a narrow molecular weight distribution, prepared over special catalysts, can also be employed. Also suitable are triglyceride alkoxylates, examples being reaction products of 1 mol of triglyceride with from 1 to 50 mol of alkylene oxide, especially from 10 to 50 mol of ethylene oxide. It is also possible to use saccharide-based surfactants, examples being alkylpolyglucosides and glucosamides.

The microemulsions employed in accordance with the invention contain preferably anionic surfactants, usually in combination with one or more nonionic surfactants. However, it is also possible to prepare microemulsions with nonionic surfactants alone.

Achieving an optimum cleaning effect in each individual case, for each combination of organic solvent, surfactant or surfactants and, if appropriate, electrolytes and complexing agents in aqueous solution requires defined, relatively narrow ranges of proportions of the individual components, which can be determined by simple routine experiments. In general, the proportion of surfactants in the microemulsion overall is in the range from 1 to 35, preferably from 1 to 25 and, in particular, from 7 to 25% by weight. Too high a proportion of surfactant may cause cleaning problems, or the drying of the printing rollers may present difficulties.

Proportions employed are generally from 1 to 20, preferably from 3 to 15 and, in particular, from 5 to 10% by weight of anionic surfactant; from 1 to 20% by weight of polyethylene glycol monoalkyl ether; from 0.1 to 10, preferably from 0.5 to 5% by weight of reaction product of triglyceride with ethylene oxide; and from 1 to 20% by weight of polyalkylene glycol monoalkyl ether with oxyethylene and/or oxypropylene units.

The microemulsions employed in accordance with the invention generally contain from 5 to 60, preferably from 20 to 60% by weight of water-immiscible organic solvent and from 20 to 80, preferably from 30 to 60% by weight of water. All percentages by weight here are based on the overall weight of the finished microemulsion.

Every microemulsion is thermodynamically stable within a defined temperature range. Preference is given to those microemulsions which are thermodynamically stable at room temperature and below. In many cases, however, it is also possible successfully to employ those microemulsions whose stability range lies above room temperature, for example, between 50 and 60° C.

High concentrations of surfactants in known cleaning liquids often lead to poor printing ink detachment in association with surfactant deposits on the printing rollers; these disadvantages do not occur with the microemulsions employed in accordance with the invention.

When the cleaning process of the invention is performed the microemulsion is applied to those parts of the printing machine that are to be cleaned. The surface of the printing ink is wetted quickly, uniformly and completely, so that the printing ink is rapidly taken up by the cleaning liquid and dissolved or emulsified, respectively. The residues of microemulsion can easily be removed by washing with water. The same applies to the residues of ink which remain on a printing plate which is to be cleaned and preserved following an interruption in printing, especially an offset or relief printing plate. The important factor here is primarily the complete removal of ink residues from the nonimage or background areas of the printing plate, on which the required hydrophilicity must be maintained, for example, in planographic or offset printing when the printing operation is resumed. Reference to a printing plate in the context of this description is to a ready-to-print plate as generally obtained by exposure and development of a photosensitive printing plate.

The microemulsions employed in accordance with the invention are also suitable for cleaning other substances, such as plastics, old coatings, primers and untreated metal panels. They can be employed, for instance, as cleaners in the automotive refinish sector, and as brush cleaners.

The examples which follow illustrate embodiments of the process of the invention, microemulsions employed in said process, and their preparation.

PREPARATION EXAMPLE 1

10 g of dioctylsulfosuccinate (sodium salt), 7 g of a polyglycol monoalkyl ether mixture with about 5 oxyethylene units and a $C_{10}$–$C_{13}$ alkyl ether group, 46 g of a $C_8$–$C_{18}$ fatty acid methyl ester mixture, 37 g of water and 0.07 g of calcium chloride were mixed and the mixture was shaken briefly to give a visually transparent microemulsion of low viscosity which was thermodynamically stable at room temperature.

PREPARATION EXAMPLE 2

A microemulsion, stable at room temperature, was prepared as described in Preparation Example 1 but from 8 g of dioctylsulfosuccinate, 16 g of the same polyglycol monoalkyl ether mixture, 15 g of rapeseed oil fatty acid methyl ester, 15 g of coconut fatty acid 2-ethylhexyl ester, 46 g of water and 0.07 g of calcium chloride.

PREPARATION EXAMPLE 3

14 g of dioctylsulfosuccinate, 34.5 g of soya oil and 51.5 g of water were mixed as in Preparation Example 1 to give a microemulsion. It was thermodynamically stable in the temperature range from 55 to 58° C., and visually transparent.

PREPARATION EXAMPLE 4

17.0 g of dioctylsulfosuccinate were dissolved in 41.5 g of water and the solution was mixed with 415 g of decane. In the temperature range from 51 to 56° C. the mixture forms a thermodynamically stable, visually transparent microemulsion of low viscosity.

Outside the stated temperature ranges the microemulsions of Preparation Examples 3 and 4 are not permanently stable and on prolonged standing at room temperature separate into an oil phase and a water phase. The microemulsions of Preparation Examples 1 and 2, on the other hand, allow use for an unlimited duration at room temperature.

USE EXAMPLE 5

In a comparative experiment the rollers of a rotary offset printing machine were cleaned, in each case following 100,000 prints with commercially customary oil-based offset printing ink, on the one hand with white spirit (predominantly aliphatic hydrocarbons with a boiling range from 80 to 250° C.) and on the other with the microemulsion of Preparation Example 1. In both cases the cleaning performance, i.e., the removal of the printing ink, was essentially the same. When the microemulsion was used, the rollers were cleaner and drier after cleaning than when white spirit was used. Furthermore, the residues of microemulsion were easily removable without residue, simply by rinsing them off with water.

In the same way, the offset printing plate employed in the printing operation was treated with both cleaning liquids. In both cases a clean print stencil was obtained, freed from ink residues. The printing plate cleaned with the microemulsion was wetted smoothly and completely by the subsequently applied aqueous solution of gum arabic, whereas even the nonimage area-forming support surface of the printing plate cleaned with white spirit accepted this solution with difficulty and only after prolonged intensive treatment.

We claim:

1. A process for cleaning printing machines and printing plates comprising removing contaminants from surfaces to be cleaned by washing them with a liquid, wherein said liquid is a bicontinuous microemulsion comprising a) from 2 to 60% by weight of an alkylester of a saturated or unsaturated fatty acid having 8 to 25 carbon atoms, wherein the alkyl group of said ester contains 1 to 20 carbon atoms, as a water-immiscible organic solvent, b) from 30 to 60% by weight of water, c) from 7 to 25% by weight of one or more surfactants, wherein the volume ratio of water to organic phase is from 40:60 to 60:40 and the interfacial tension between water and organic phase is in the range from $10^{-4}$ to $10^{-6}$ N/m.

2. A process as claimed in claim 1, characterized in that said washing is conducted in a temperature range within which the microemulsion is thermodynamically stable.

3. A process as claimed in claim 1, wherein said surfactant is an anionic surfactant.

4. A process as claimed in claim 3, wherein said microemulsion additionally comprises a nonionic surfactant.

5. A process as claimed in claim 1, wherein an electrolyte is present in solution in said water.

6. A process as claimed in claim 5, wherein said electrolyte is a water-soluble alkali metal salt or alkaline earth metal salt.

7. A process as claimed in claim 1, wherein a complexing agent or a corrosion inhibitor is present in solution in said water.

* * * * *